US006998035B2

(12) United States Patent
Narita et al.

(10) Patent No.: US 6,998,035 B2
(45) Date of Patent: Feb. 14, 2006

(54) METHOD FOR FORMING RE-CR ALLOY FILM THROUGH ELECTROPLATING PROCESS USING BATH CONTAINING CR(VI)

(75) Inventors: Toshio Narita, Hokkaido (JP); Shigenari Hayashi, Hokkaido (JP); Takayuki Yoshioka, Kanagawa (JP); Hiroshi Yakuwa, Kanagawa (JP); Michiaki Souma, Hokkaido (JP)

(73) Assignees: Japan Science And Technology Agency, Saitama (JP); Ebara Corporation, Tokyo (JP); Sapporo Electroplating Industrial Co., Ltd., Sapporo (JP)

( * ) Notice: Subject to any disclaimer, the term of this patent is extended or adjusted under 35 U.S.C. 154(b) by 0 days.

(21) Appl. No.: 10/502,027

(22) PCT Filed: Jan. 17, 2003

(86) PCT No.: PCT/JP03/00355

§ 371 (c)(1),
(2), (4) Date: Apr. 4, 2005

(87) PCT Pub. No.: WO03/062502

PCT Pub. Date: Jul. 31, 2003

(65) Prior Publication Data

US 2005/0167282 A1 Aug. 4, 2005

(30) Foreign Application Priority Data

Jan. 18, 2002 (JP) ..... 2002-010752

(51) Int. Cl.
*C25D 3/56* (2006.01)

(52) U.S. Cl. ..... 205/238; 205/243

(58) Field of Classification Search ..... 205/238, 205/243
See application file for complete search history.

(56) References Cited

U.S. PATENT DOCUMENTS 3,285,839 A 11/1966 Camp
3,668,083 A 6/1972 Meyer et al.
4,477,318 A * 10/1984 Tomaszewski ..... 205/101
4,778,573 A 10/1988 Tabe et al.
6,077,413 A * 6/2000 Hafeli et al. ..... 205/170

FOREIGN PATENT DOCUMENTS

JP 54-93453 7/1979

OTHER PUBLICATIONS

F. A. Lowenheim, Electroplating, McGraw-Hill Book Co. New York, 1978, pp230-233, 363-373.*

(Continued)

*Primary Examiner*—Roy King
*Assistant Examiner*—William T. Leader
(74) *Attorney, Agent, or Firm*—Westerman, Hattori, Daniels & Adrian, LLP

(57) ABSTRACT

Disclosed is a method for forming a Re—Cr alloy film consisting of Re in the range of 60 to 90% by atomic composition. The method comprises performing an electroplating process using an electroplating bath containing an aqueous solution which includes a perrhenate ion and a chromium (VI) ion. The present invention allows a Re—Cr alloy film usable as a corrosion-resistant alloy coating for a high-temperature component or the like to be formed through an electroplating process using an aqueous solution, so as to provide heat/corrosion resistances to the component, even if it has a complicated shape, in a simplified manner at a low cost.

3 Claims, 1 Drawing Sheet

OTHER PUBLICATIONS

Patent Abstracts of Japan, Publication No. 09-302496, dated Nov. 25, 1997. Cited in the international search report.
Hisanori Fukushima, Ammonia-sei Kuensan' en Yokukara no Re-Ni Gokin Denchaku, Kinzoku Hyomen Shori, vol. 36, No. 5, pp. 198-203, 1985, Cited in the international search report.
Patent Abstracts of Japan, Publication No. 09-302495, dated Nov. 25, 1997. Cited in the specification.

* cited by examiner

METHOD FOR FORMING RE-CR ALLOY FILM THROUGH ELECTROPLATING PROCESS USING BATH CONTAINING CR(VI)

TECHNICAL FIELD

The present invention relates to a method for forming a Re—Cr alloy usable as a corrosion-resistant coating for high-temperature components or the like.

BACKGROUND ART

A Ni-based superalloy substrate for use in a blade for jet engines, gas turbines or the like is strictly required to have high oxidation resistance and corrosion resistance. Such required high-temperature oxidation resistance has been obtained through a surface diffusion treatment, for example, by coating a substrate surface with an $Al_2O_3$ film. For covering the insufficient performance of this treatment, there has also been developed a technique for forming a diffusion barrier layer of Pt or the like on a substrate. Rhenium (Re) can be used as the diffusion barrier layer to provide enhanced high-temperature corrosion resistance. Re excellent in thermal shock resistance is also used as high-temperature members or components of various combustors, such as a rocket-engine combustor, or high-temperature nozzles. Heretofore, there have been known the following processes for forming a Re-based film or a Re alloy film.

(1) Sputtering Process or Physical Deposition Process

A physical deposition process allows a film thickness and/or composition to be readily controlled. On the other hand, it involves problems, such as, (i) many restrictions on the size and shape of a substrate, (ii) the need for a large-scaled apparatus and complicated operations and (iii) a relatively large number of defects or cracks in an obtained film.

(2) Thermal Spraying Process

A thermal spraying process involves problems, such as, (i) a relatively large number of defects in an obtained film, (ii) lack of compatibility to the formation of thin films (10 $\mu$m or less) and (iii) poor process yield and low economical efficiency.

(3) Re-Alloy Electroplating Process

There have been known a Ni—Cr—Re alloy film having a Re content of up to 50 weight % (this percentage becomes lower when converted into atomic composition ratio), a Ni—Co—Re alloy film (see, for example, Japanese Patent Laid-Open Publication Nos. 09-302495 and 09-302496), and a Re—Ni alloy film for electric contacts, which has a Re content of up to 85 weight % (63 atomic %) (see, for example, Japanese Patent Laid-Open Publication No. 54-93453). In all of the above plated films, the content of Re is in a low level.

DISCLOSURE OF INVENTION

In view of the above circumstances, it is therefore an object of the present invention to provide a method capable of forming a Re—Cr alloy film on a surface having a complicated shape, which cannot be achieved by a sputtering process or physical deposition process.

It is another object of the present invention to provide a method capable of forming a Re—Cr alloy film at a thin thickness, which cannot be achieved by a thermal spraying process.

It is still another object of the present invention to provide a method capable of forming a Re—Cr alloy film through an electroplating process at a low cost in a simplified manner as compared to the physical deposition process and the thermal spraying process.

Through various researches for achieving the above objects, the inventors found that a Re—Cu alloy film can be electrolytically deposited using an aqueous solution containing perrhenate (heptavalent rhenium) and chromate (hexavalent chromium).

Specifically, the present invention provides a method for forming a Re—Cr alloy film, comprising performing an electroplating process using a plating bath which contains an aqueous solution including a perrhenate ion in a concentration of 0.01 to 2.0 mol/L, and a chromium (VI) ion in a concentration of 0.01 to 3.0 mol/L. In this method, the plating bath has a pH of 0 to 8, and a temperature of 10 to 80° C.

In the above method of the present invention, if the concentration of perrhenate ion is less than 0.01 mol/L, no Re will be contained in a resulting plated film. Further, the use of a concentration of perrhenate ion greater than 2.0 mol/L causes significant deterioration in plating efficiency. The use of a concentration of chromium (VI) ion less than 0.01 mol/L causes significant deterioration in plating efficiency. If the concentration of chromium (VI) ion is greater than 3.0 mol/L, only Cr will be electrolytically deposited by priority. For these reasons, the concentration of the perrhenate ion is defined in the range of 0.01 to 2.0 mol/L, and the concentration of the chromium (VI) ion is defined in the range of 0.01 to 3.0 mol/L.

In the method of the present invention, the electroplating bath has a pH of 0 to 8 and a plating temperature of 10 to 80° C. This provides a high covering power and a plated film having a homogeneous composition. The use of a pH less than 0 (zero) causes deterioration in covering cover, and the use of a pH greater than 8 causes deteriorated flowability due to creation of a large amount of insoluble substance. Further, the use of a plating temperature less than 10° C. causes significant deterioration in electrolytic deposition efficiency, and the use of a plating temperature greater than 80° C. causes deterioration in covering power. For these reasons, the pH of the bath is defined in the range of 0 to 8, and the plating temperature of the bath is defined in the range of 10 to 80° C. Preferably, the bath pH is set in the range of 0 to 2, and the plating temperature is set in the range of 40 to 60° C.

In the method of the present invention, the alloy film to be formed has a composition consisting of Re in the range of 60 to 90% by atomic composition, and the remainder being Cr except inevitable impurities. This alloy film can have desired functions depending on the type of substrate and an intended purpose.

Further, in the method of the present invention, the plating bath may contain a chromium (III) ion in a concentration of 0.0001 to 0.03 mol/L and/or a sulfate ion in a concentration of 0.0001 to 0.03 mol/L. These substances act as a catalytic agent for electrolytic deposition of Cr to improve the plating efficiency and educe the occurrence of spots in a plated film. This effect cannot be obtained by a concentration of chromium (III) ion or sulfate ion less than 0.0001 mol/L, and the use of a concentration of chromium (III) ion or sulfate ion grater than 0.03 mol/L has the opposite effect or causes deterioration in current efficiency. Therefore, the concentration of the chromium (III) ion or sulfate ion is preferably set in the range of 0.0001 to 0.03 mol/L.

BEST MODE FOR CARRYING OUT THE INVENTION

INVENTIVE EXAMPLE 1

Figure 1:
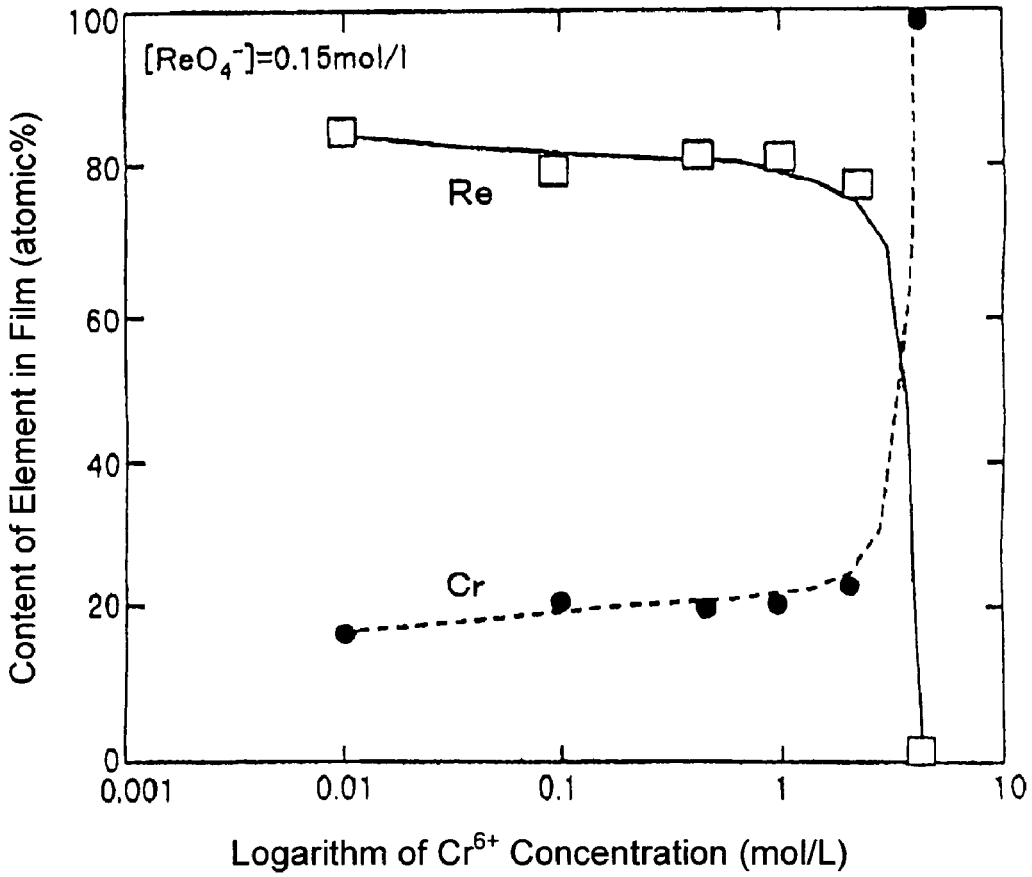
FIG. 1 is a graph showing the relationship between the composition of a plated film and the molar concentration of $Cr^{6+}$ in a plating bath in each of Inventive Examples and Comparative Examples.

A copper plate was subjected to degreasing/cleaning, and used as a substrate. A solution was prepared using chromic anhydride to have a $Cr^{6+}$ ion in a concentration of 0.01 mol/L In addition to the $Cr^{6+}$ ion, 0.15 mol/L of $ReO_4^-$, 0.01 mol/L of chromium chloride, and 0.01 mol/L of sulfuric acid were added to the solution to prepare a plating bath. The pH of the plating bath was adjusted at 0 (zero). Then, an electroplating process was performed for 1 hour under a plating bath temperature of 50° C. and a current density of 100 mA/cm$^2$.

INVENTIVE EXAMPLE 2

Except that the concentration of the $Cr^{6+}$ was set at 0.1 mol/L, an electroplating process was performed under the same conditions as those in Inventive Example 1.

INVENTIVE EXAMPLE 3

Except that the concentration of the $Cr^{6+}$ was set at 0.5 mol/L, an electroplating process was performed under the same conditions as those in Inventive Example 1.

INVENTIVE EXAMPLE 4

Except that the concentration of the $Cr^{6+}$ was set at 1.0 mol/L, an electroplating process was performed under the same conditions as those in Inventive Example 1.

INVENTIVE EXAMPLE 5

Except that the concentration of the $Cr^{6+}$ was set at 2.0 mol/L, an electroplating process was performed under the same conditions as those in Inventive Example 1.

COMPARATIVE EXAMPLE 1

Except that the concentration of the $Cr^{6+}$ was set at 0.001 mol/L, an electroplating process was performed under the same conditions as those in Inventive Example 1.

COMPARATIVE EXAMPLE 2

Except that the concentration of the $Cr^{6+}$ was set at 5.0 mol/L, an electroplating process was performed under the same conditions as those in Inventive Example 1.

FIG. 1 shows the relationship between the composition of a plated film and the molar concentration of $Cr^{6+}$ in the plating bath in each of Inventive Examples and Comparative Examples. In Comparative Example 1 using the bath containing $Cr^{6+}$ in a concentration of 0.001 mol/L, any film having a stable composition could not be obtained due to significantly deteriorated current efficiency. In the $Cr^{6+}$ concentration range of Inventive Examples 1 to 5, a plated film had a composition comprising about 78 to 82 atomic % of Re and about 22 to 19 atomic % of Cr. The plated film obtained in Comparative Example 2 using the bath containing $Cr^{6+}$ in a concentration of 5.0 mol/L had a composition comprising approximately 100 atomic % of Cr.

INDUSTRIAL APPLICABILITY

The present invention allows a Re—Cr alloy film usable as a corrosion-resistant alloy coating for a high-temperature component or the like to be formed through an electroplating process using an aqueous solution, so as to provide heat/corrosion resistances to the component, even if it has a complicated shape, in a simplified manner at a low cost.

What is claimed is:

1. A method for forming a Re—Cr alloy film, comprising performing an electroplating process using a plating bath which contains an aqueous solution including:

a perrhenate ion in a concentration of 0.01 to 2.0 mol/L; and a chromium (VI) ion in a concentration of 0.01 to 3.0 mol/L, wherein said plating bath has a pH of 0 to 8, and a temperature of 10 to 80° C.

2. The method as defined in claim 1, wherein said alloy film to be formed has a composition consisting of Re in the range of 60 to 90% by atomic composition, and the remainder being Cr except inevitable impurities.

3. The method as defined in claim 1, wherein said plating bath contains a chromium (III) ion in a concentration of 0.0001 to 0.03 mol/L and/or a sulfate ion in a concentration of 0.0001 to 0.03 mol/L.

* * * * *